US006465970B2

(12) United States Patent
Nagakubo et al.

(10) Patent No.: US 6,465,970 B2
(45) Date of Patent: Oct. 15, 2002

(54) PLASMA DISPLAY PANEL DRIVING METHOD

(75) Inventors: Tetsuro Nagakubo; Tetsuya Shigeta; Hirofumi Honda, all of Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/863,757

(22) Filed: May 24, 2001

(65) Prior Publication Data

US 2002/0014847 A1 Feb. 7, 2002

(30) Foreign Application Priority Data

May 24, 2000 (JP) ..... 2000-153130

(51) Int. Cl.[7] ..... G09G 3/10; G09G 3/30
(52) U.S. Cl. ..... 315/169.4; 345/76
(58) Field of Search ..... 315/169.1, 169.3, 315/169.4; 345/41, 42, 48, 55, 60, 63, 204, 214, 690, 76

(56) References Cited

U.S. PATENT DOCUMENTS 5,757,343 A * 5/1998 Nagakubo ..... 345/63
6,256,002 B1 * 7/2001 Shinoda ..... 345/60
6,369,514 B2 * 4/2002 Awamoto ..... 315/169.1
6,384,803 B2 * 5/2002 Kasahara et al. ..... 345/63
6,392,616 B1 * 5/2002 Suzuki et al. ..... 345/60

* cited by examiner

*Primary Examiner*—Don Wong
*Assistant Examiner*—Minh D A

(57) ABSTRACT

A plasma display device which improves the contrast of an image displayed. The plasma display device includes a plurality of row electrodes formed in pairs corresponding to each display line, a plurality of column electrodes arranged to cross the row electrodes to form a discharge cell corresponding to one pixel at each intersection with a pair of said row electrodes, and a driving controller for controlling driving of the row and column electrodes. A gradation display of input pixel data is performed by dividing one field display period into a plurality of subfields. The driving controller, when one field of input pixel data is displayed, changes the number of reset discharges for initializing all discharge cells in accordance with an average luminance value of input pixel data in the preceding field.

6 Claims, 13 Drawing Sheets

FIG. 11

[SELECTIVE ERASURE]

| GRADATION LEVEL | SF1 | SF2 | SF3 | SF4 | SF5 | SF6 | SF7 | SF8 | LUMINANCE INTENSITY |
|---|---|---|---|---|---|---|---|---|---|
| 1 | ● | | | | | | | | 0 |
| 2 | ○ | ● | | | | | | | 1 |
| 3 | ○ | ○ | ● | | | | | | 7 |
| 4 | ○ | ○ | ○ | ● | | | | | 23 |
| 5 | ○ | ○ | ○ | ○ | ● | | | | 47 |
| 6 | ○ | ○ | ○ | ○ | ○ | ● | | | 82 |
| 7 | ○ | ○ | ○ | ○ | ○ | ○ | ● | | 128 |
| 8 | ○ | ○ | ○ | ○ | ○ | ○ | ○ | ● | 185 |
| 9 | ○ | ○ | ○ | ○ | ○ | ○ | ○ | ○ | 255 |

FIG. 13

[SELECTIVE ERASURE]

| GRADATION LEVEL | DATA CONVERSION TABLE | | | | | | | | | | LIGHT EMISSION DRIVING PATTERN | | | | | | | | LUMINANCE INTENSITY |
|---|---|---|---|---|---|---|---|---|---|---|---|---|---|---|---|---|---|---|---|
| | Ds | HD | | | | | | | | | SF 1 | SF 2 | SF 3 | SF 4 | SF 5 | SF 6 | SF 7 | SF 8 | |
| | | 1 | 2 | 3 | 4 | 5 | 6 | 7 | 8 | | | | | | | | | | |
| 1 | 0000 | 1 | 0 | 0 | 0 | 0 | 0 | 0 | 0 | | ● | | | | | | | | 0 |
| 2 | 0001 | 0 | 1 | 0 | 0 | 0 | 0 | 0 | 0 | | ○ | ● | | | | | | | 1 |
| 3 | 0010 | 0 | 0 | 1 | 0 | 0 | 0 | 0 | 0 | | ○ | ○ | ● | | | | | | 7 |
| 4 | 0011 | 0 | 0 | 0 | 1 | 0 | 0 | 0 | 0 | | ○ | ○ | ○ | ● | | | | | 23 |
| 5 | 0100 | 0 | 0 | 0 | 0 | 1 | 0 | 0 | 0 | | ○ | ○ | ○ | ○ | ● | | | | 47 |
| 6 | 0101 | 0 | 0 | 0 | 0 | 0 | 1 | 0 | 0 | | ○ | ○ | ○ | ○ | ○ | ● | | | 82 |
| 7 | 0110 | 0 | 0 | 0 | 0 | 0 | 0 | 1 | 0 | | ○ | ○ | ○ | ○ | ○ | ○ | ● | | 128 |
| 8 | 0111 | 0 | 0 | 0 | 0 | 0 | 0 | 0 | 1 | | ○ | ○ | ○ | ○ | ○ | ○ | ○ | ● | 185 |
| 9 | 1000 | 0 | 0 | 0 | 0 | 0 | 0 | 0 | 0 | | ○ | ○ | ○ | ○ | ○ | ○ | ○ | ○ | 255 |

BLACK CIRCLE : SELECTIVE ERASURE DISCHARGE
WHITE CIRCLE : LIGHT EMISSION

PLASMA DISPLAY PANEL DRIVING METHOD

BACKGROUND OF THE INVENTION

1. Field of the Invention

The present invention relates to a method for driving a plasma display panel (hereinafter referred to as "PDP") of a matrix display scheme.

2. Description of the Related Art

An AC (alternate current discharge) type PDP is well-known, as one type of the display panels using a matrix display scheme.

The AC type PDP comprises a plurality of column electrodes (address electrodes) and a plurality of row electrodes arranged perpendicular to the column electrodes and forming one scanning line per pair. Each of the row electrodes and column electrodes is covered with a dielectric layer to separate them from a discharge space. The PDP has a structure in which a discharge cell corresponding to one pixel is formed at an intersection of a pair of row electrodes and a column electrode.

Japanese Patent kokai No. 4-195087 discloses a method for performing a halftone display for the PDP, a so-called subfield method by which one field period is divided into N subfields, in each of which light is emitted for a time period corresponding to weighting of each bit digit of N-bit pixel data.

When the subfield method is used, assuming that supplied pixel data comprises six bits, one field period is divided into six subfields SF1, SF2, . . . , and SF6, and a light emitting operation is performed in each subfield. When the light emission in the six subfields has been performed once, 64-gradation display can be provided for one field of image.

Each subfield comprises a simultaneous reset step Rc, a pixel data writing step Wc, and a light emission sustaining step Ic. In the simultaneous reset step Rc, all discharge cells of the PDP are simultaneously discharged (reset discharge), so that wall charges are uniformly erased in all the discharge cells. In the next pixel data writing step Wc, a selective writing discharge in each discharge cell is produced in accordance with pixel data. At this time, in a discharge cell in which the writing discharge is performed, a wall charge is formed to be a "light emitting cell." On the other hand, a discharge cell in which the writing discharge has not been performed remains without a wall charge, so that it becomes a "non-light emitting cell." In the light emission sustaining step Ic, only the light emitting cells are forced to continue a light emitting state for a duration corresponding to weighting of each subfield. In this way, the sustaining light emission is performed at a light emitting duration ratio of 1:2:4:8:16:32 in order in each subfield SF1–SF6.

However, the reset discharge performed for all the discharge cells in the simultaneous reset step Rc involves a relatively strong discharge, i.e., light emission with a high luminance level. Also, since light emission free from pixel data occurs due to the reset discharge, there is a problem that the contrast of an image is reduced. Also, the power consumption due to the light emission also constitutes the cause of preventing a reduction in power consumption of the PDP.

OBJECT AND SUMMARY OF THE INVENTION

It is an object of the present invention to provide a method for driving a plasma display apparatus which has an improved contrast while reducing power consumption.

In accordance with one aspect, the present invention is characterized by a method for driving a plasma display panel on the basis of input pixel data of a field comprising a plurality of row electrodes formed in pairs corresponding to each of a plurality of display lines, a plurality of column electrodes arranged to cross said row electrodes, each of said column electrodes forming a discharge cell corresponding to one pixel at each intersection with a pair of said plurality of row electrodes, a row electrode driving circuit for generating a row electrode driving pulse for driving said plurality of row electrodes, and a column electrode driving circuit for generating a column electrode driving pulse for driving said plurality of column electrodes. The method comprises the steps of (a) performing a reset discharge for initializing all of said discharge cells in said field, and (b) dividing a display period in said field into a plurality of subfields to perform a gradation display, further comprising the step (c) of changing the number of reset discharges in said step (a) in accordance with luminance data in said input pixel data in a field preceding to said field, when said field is displayed.

In accordance with another aspect, the invention is characterized by a method for driving a plasma display panel on the basis of input pixel data of a field, said plasma display panel comprising a plurality of row electrodes formed in pairs corresponding to each of a plurality of display lines, a plurality of column electrodes arranged to cross said row electrodes, each of said column electrodes forming a discharge cell corresponding to one pixel at each intersection with a pair of said plurality of row electrodes, a row electrode driving circuit for generating a row electrode driving pulse for driving said plurality of row electrodes, and a column electrode driving circuit for generating a column electrode driving pulse for driving said plurality of column electrodes. The method comprises the steps of (d) dividing a display period of said field into a plurality of subfields to perform a gradation display, and (e) performing a reset discharge for initializing all of said discharge cells in each of said subfields, further comprising the step (f) of changing the number of said reset discharges in said step (e) in accordance with luminance data of input pixel data in a preceding field to said field, when said input pixel data is displayed.

In accordance with further aspect, the invention is characterized by a method for driving a plasma display panel on the basis of input pixel data of a field, said plasma display panel comprising a plurality of row electrodes formed in pairs corresponding to each of a plurality of display lines, a plurality of column electrodes arranged to cross said row electrodes, each of said column electrodes forming a discharge cell corresponding to one pixel at each intersection with a pair of said plurality of row electrodes, a row electrode driving circuit for generating a row electrode driving pulse for driving said plurality of row electrodes, and a column electrode driving circuit for generating a column electrode driving pulse for driving said plurality of column electrodes. The method comprises the steps of (g) dividing a display period of said field into a plurality of subfields to perform a gradation display to perform a gradation display, and (h) performing a reset discharge for initializing all of said discharge cells in a first subfield of said field, further comprising the step of (i) changing the number of said reset discharges in said step (h) in accordance with luminance data of input pixel data in a preceding field to said field when said input pixel data is displayed.

According to the present invention, when one field of input pixel data is displayed, the number of reset discharges for initializing all discharge cells in every field display period is changed in accordance with luminance data of one field of input pixel data of the previous field to this field, so that the contrast of a screen can be improved by suppressing light emission by a discharge which does not relate directly to a display.

BRIEF DESCRIPTION OF THE DRAWINGS

The aforementioned aspects and other features of the invention are explained in the following description, taken in connection with the accompanying drawing figures wherein:

FIG. 11 is a diagram showing an example of light emission driving pattern performed based on the light emission driving format illustrated in FIG. 10;

FIG. 13 is a diagram showing all patterns of light emission driving performed based on the light emission driving format illustrated in FIG. 10, and an example of conversion table when the light emission driving is performed.

DETAILED DESCRIPTION OF THE PREFERRED EMBODIMENTS

Preferred embodiments of the present invention will be described with reference to the drawings.

Figure 1:
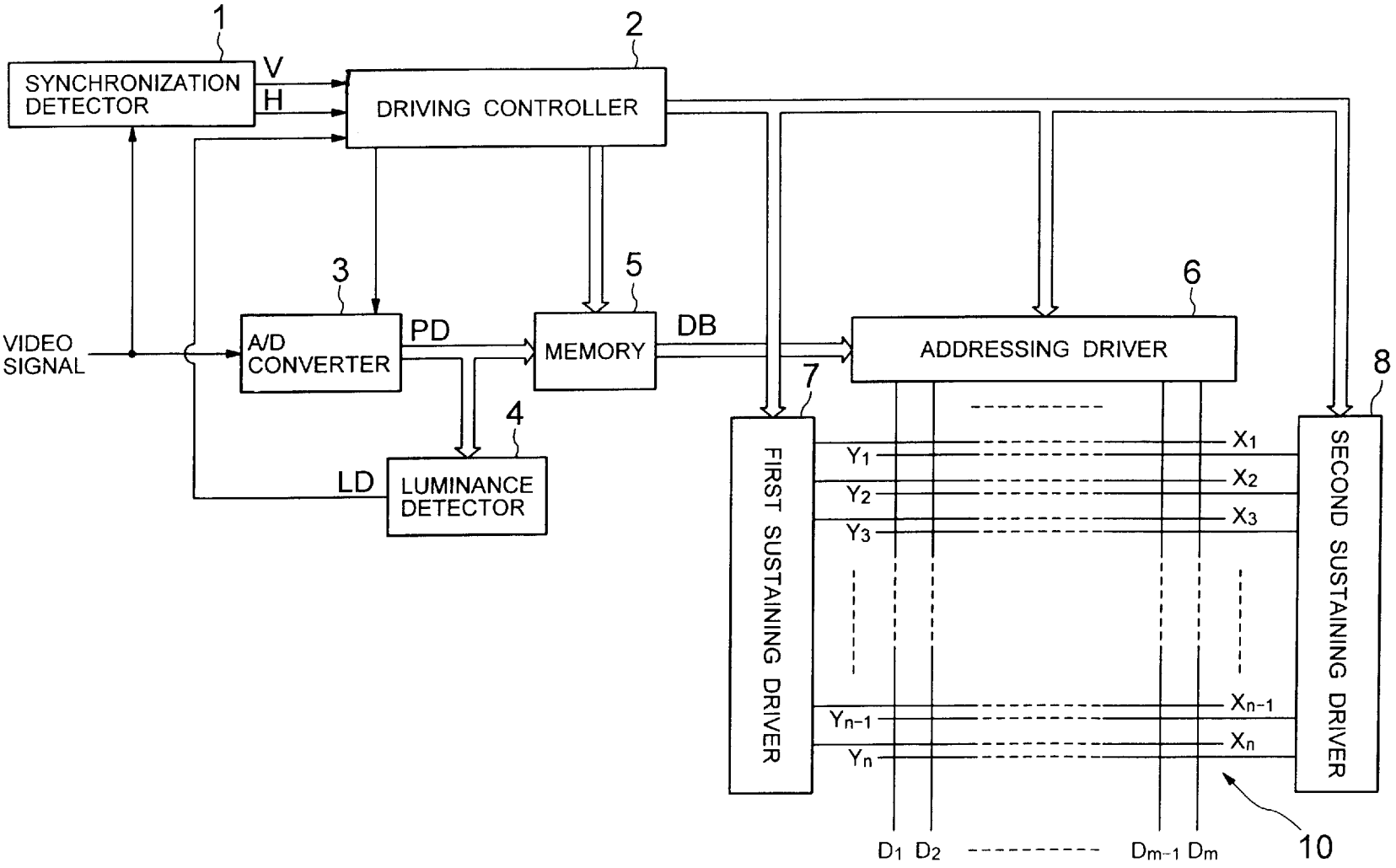
FIG. 1 is a block diagram illustrating a plasma display apparatus for driving a plasma display panel in accordance with a method according to the present invention.

FIG. 1 is a block diagram illustrating a plasma display apparatus with a device for driving a plasma display panel (hereinafter referred to as the PDP) based on a method according to the present invention.

Referring to FIG. 1, the plasma display apparatus comprises a PDP 10, and a driving unit with various functional modules.

In FIG. 1, the PDP 10 comprises m column electrodes $D_1$–$D_m$ as address electrodes, and n row electrodes $X_1$–$X_n$ and n row electrodes $Y_1$–$Y_n$ which are arranged to intersect each of these column electrodes. These row electrodes $X_1$–$X_n$ and row electrodes $Y_1$–$Y_n$ provide a first display line through an n-th display line on the PDP 10 respectively in pairs of row electrode $X_i$ (1<i21n) and $Y_i$ (1<i<n). A discharge space encapsulated with a discharge gas is formed between the column electrodes D and the row electrodes X and Y. Then, a pixel cell corresponding to one pixel is formed at an intersection of each row electrode pair which surrounds the discharge cell, and a column electrode. In other words, m pixel cells equal to the number of the column electrodes exist on one display line.

Figure 2:
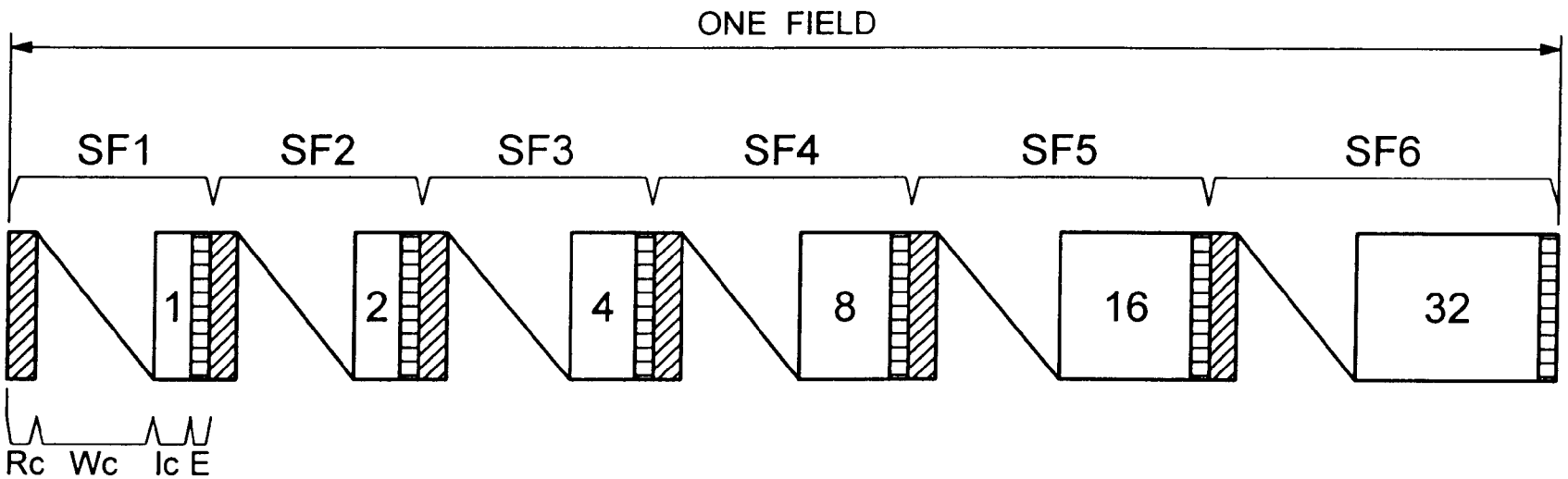
FIG. 2 is a diagram illustrating a light emission driving format for performing a halftone display.

The driving unit comprises a synchronization detector 1, a driving controller 2, an A/D converter 3, a luminance detector 4, a memory 5, an addressing driver 6, a first sustaining driver 7, and a second sustaining driver 8. The driving unit divides one field display period into, for example, six subfields SF1-SF6, as illustrated in FIG. 2, and drives the PDP 10 in gradation based on the aforementioned subfield method. At this time, the driver unit executes a simultaneous reset step Rc, a pixel data writing step Wc, a light emission sustaining step Ic, and an erasure step E respectively in each subfield.

The synchronization detector 1 detects a vertical synchronization signal from an input video signal, and generates a vertical synchronization detecting signal V. The synchronization detector 1 also detects a horizontal synchronization signal, and generates a horizontal synchronization detecting signal H. Next, the detector 1 supplies the vertical and horizontal synchronization signals V, H to the driving controller 2.

The driving controller 2 generates a clock signal to the A/D converter 3 and write/read signals to the memory 5 in synchronism with the horizontal and vertical synchronization signals. The driving controller 2 also generates various timing signals for controlling each of the A/D converter 3, memory 5, addressing driver 6, first sustaining driver 7, and second sustaining driver 8 in synchronism with the horizontal and vertical synchronization signals.

The A/D converter 3 samples an analog input video signal in response to a clock signal supplied from the driving controller 2. Next, the A/D converter 3 converts a sampled signal to 6-bit pixel data PD representative of a luminance level of each pixel which is supplied to the memory 5.

The luminance detector 4 receives luminance data comprising six bits of pixel data PD, and calculates an average luminance level LD for each field from the luminance data in the pixel data. Next, the luminance detector 4 supplies the average luminance level LD to the driver controller 2.

When the driving controller 2 receives the average luminance level LD from the luminance detector 4, the driving controller 2 selects a configuration pattern of one field for controlling light emission driving for the PDP dependently on the average luminance level LD from three configuration patterns, later described. Then, the driving controller 2 generates signals required for driving the PDP, i.e., a pixel data timing signal, a reset timing signal, a scanning timing signal, and a sustaining timing signal in accordance with the selected configuration pattern of one field.

The memory 5 sequentially receives the pixel data PD supplied from the A/D converter 3 in response to the write signal supplied from the driving controller 2. Then, every time the memory 5 finished receiving of the pixel data PD for one screen, i.e., (n×m) pixel data PD from pixel data $PD_{11}$ corresponding to the pixel at the first row, first column to the pixel data $PD_{nm}$ corresponding to a pixel at the n-th row, m-th column, the memory 5 performs a reading operation as follows in response to a read signal from the driving controller 2.

In the first subfield SF1, the memory 5 regards the first bit of each of drive pixel data $PD_1$–$PD_{nm}$ as a pixel data bit $DB1_{11}$–$DB1_{nm}$, and reads them for each display line, and supplies them to the addressing driver 6. In the next subfield SF2, the memory regards the second bit of each of pixel data $PD_{11}$–$PD_{nm}$ as a driving pixel data bit $DB2_{11}$–$DB2_{nm}$, and reads them for each display line, and supplies them to the addressing driver 6. In other words, as described above, in each of the subfields Sfi (1<i<6), data of bit corresponding to each of the pixel data $PD_{11}$–$PD_{nm}$ is read for one display line, and supplied to the addressing driver 6. Then, at the last subfield SF6, the memory 5 regards the sixth bit of each of pixel data $PD_{11}$–$PD_{nm}$ as a driving pixel data bit $DB4_{11}$–$DB4_{nm}$, and reads them for each display line, and supplies them to the addressing driver 6.

The addressing driver 6 generates pixel data pulses $DP_1$–$DP_m$ having a voltage corresponding to a logical level of each pixel data bit group for each line read from the memory 5, and applies them to the column electrodes $D_1$–$D_m$ of the PDP 10, respectively.

The first sustaining driver 7 generates each of a reset pulse $RP_x$ for controlling the amount of residual charge, a sustain pulse $IP_x$ for sustaining a discharge light emitting state, and an erasure pulse EP for stopping a sustaining discharge in response to a variety of timing signals supplied from the driving controller 2, and applies them to the row electrodes $X_1$–$X_n$ of the PDP 10.

The second sustaining driver 8 generates a reset pulse $RP_Y$ for controlling the amount of residual charge, a scanning pulse SP for writing pixel data, and a sustain pulse $IP_Y$ for sustaining a discharge light emitting state in response to a variety of timing signals supplied from the driving controller 2, and applies them to the row electrodes $Y_1$–$Y_n$ of the PDP 10.

The PDP 10 forms row electrodes corresponding to one line of the screen in a pair of a row electrode X and a row electrode Y. For example, a row electrode pair on the first line of the PDP 10 is row electrodes $X_1$ and $Y_1$, and an n-th row electrode pair is row electrodes $X_n$ and $Y_n$. Also, in the PDP 10, a discharge cell is formed at an intersection of a row electrode pair and a column electrode.

Next, a first embodiment of the operation of the PDP will be described with reference to FIG. 3.

There exist three configurations for subfields in one field selected in accordance with the average luminance level LD of one field of pixel data PD. As illustrated in FIG. 2, one field consists of six subfields SF1–SF6 in order. The driving unit performs gradation driving for the PDP 10 based on the subfield method.

A subfield basically comprises a simultaneous reset step Rc, a pixel data writing step Wc, a light emission sustaining step Ic, and an erasure step E. From the beginning of the subfield, the simultaneous reset step Rc, the pixel data writing step Wc, the light emission sustaining step Ic, and the erasure step E are performed in order. The simultaneous reset step Rc may be omitted in some subfields.

Next, the operation in each step will be described.

Figure 3:
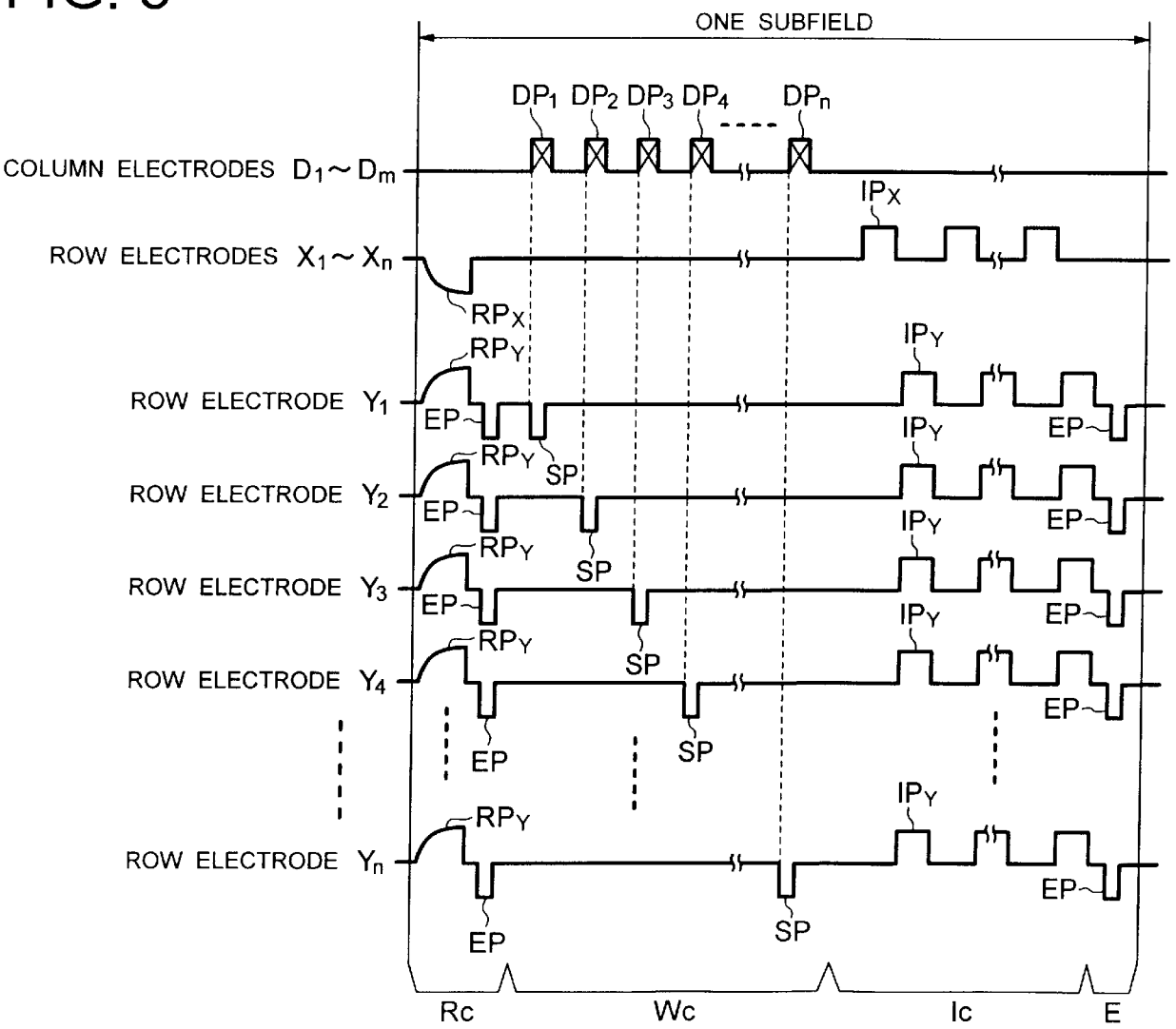
FIG. 3 is a timing diagram showing an example of application timings of driving pulses applied to a PDP 10.

In FIG. 3, in the simultaneous reset step Rc, the first sustaining driver 7 generates a reset pulse RPX of negative polarity, for example, which is applied to the row electrodes $X_1$–$X_n$. Further, simultaneously with the generation of the reset pulse $RP_x$, the second sustaining driver 8 generates reset pulses $RP_Y$ of positive polarity which are applied to the row electrodes $Y_1$–$Y_n$. As these reset pulses $RP_x$ and $RP_Y$ are simultaneously applied, reset discharges are produced in all discharge cells of the PDP 10, and a wall charge and a space charge are produced in each discharge cell. Immediately after that, the second sustaining driver 8 generates erasure pulses EP of negative polarity which applied to the row electrodes $Y_1$–$Y_n$. As the erasure pulses are applied, erasure discharges occur in all the discharge cells to extinguish the wall charges formed in the discharge cells. In this way, all the discharge cells are set to a "non-light emitting cell" state.

Next, in the pixel data writing step Wc, the addressing driver 6 generates a pixel data pulse having a pulse voltage corresponding to a driving pixel data bit DB supplied from the memory 5. In this embodiment, the addressing driver 6 generates a pixel data pulse at a high voltage when the logical level of the driving pixel data bit DB is "1", and generates a pixel data pulse at a low voltage (0 volt) when the logical level of the driving pixel data bit DB is "0." Then, the addressing driver 6 sequentially applies the column electrodes $D_1$–$D_m$ with pixel data pulse groups $DP_1$–$DP_n$ which are grouped from the pixel data pulses for each display line, corresponding to each of the first through n-th display lines.

Further, in the pixel data writing step Wc, the second sustaining driver 8 generates a scanning pulse SP of negative polarity at the same timing as the application timing of each of the pixel data pulse groups $DP_1$–$DP_n$, and sequentially applies them to the row electrodes $Y_1$–$Y_n$. Here, a discharge occurs only in discharge cells at intersections of display lines applied with the scanning pulse SP and "columns" applied with the pixel data pulse at the high voltage (selective writing discharge). After termination of the selective writing discharge, the application of voltages with the scanning pulse SP and the pixel data pulse groups DP continues, so that the wall charge is gradually formed in the discharge cell. Thus, the discharge cell is set to a "light emitting cell." On the other hand, the selective writing discharge as described above is not produced in a discharge cell which is applied with the pixel data pulse at the low voltage, although it is applied with the scanning pulse SP. That is, the cell remains as a "non-light emitting cell." Therefore, in the pixel data writing step Wc, every discharge cell in the PDP 10 is set to a state (a "light emitting cell" or a "non-light emitting cell") corresponding to the pixel data PD.

Next, in the light emission sustaining step Ic, the first sustaining driver 7 and the second sustaining driver 8 alternately apply the sustaining pulses $IP_X$ and $IP_Y$ of positive polarity to the row electrodes $X_1$–$X_n$ and $Y_1$–$Y_n$. At this time, the number (or a period) of application of the sustaining pulses IP in the light emission sustaining step Ic differs from one subfield to another in one field. Specifically, when the number of application in the subfield SF1 is assumed to be "1," the number of application of the sustaining pulses IP in the other subfields SF2–SF6 are as follows:

SF1: 1
SF2: 2
SF3: 4
SF4: 8
SF5: 16
SF6: 32

By applying the sustaining pulses, only discharge cells in which the wall charge exists, i.e., the discharge cells set to the "light emitting cell" discharge each time the sustaining pulses $IP_X$ and $IP_Y$ are applied. The cells then sustain the light emitting state associated with the discharge by the number of application (or for the period). On the other hand, the discharge cells which have been set to the "non-light emitting cell" do not at all emit light, since no discharge can be produced by the application of the sustaining pulses.

Further, in the erasure step E, the second sustaining driver 8 generates erasure pulses EP of negative polarity, and simultaneously supplies them to all the row electrodes $Y_1$–$Y_n$. By applying the erasure pulse, a discharge occurs in the discharge cells which have been set to "light emission" to extinguish the wall charges remaining in the discharge cells.

In this way, in each subfield, each discharge cell is forced to selectively discharge in accordance with an input video signal to write data, and a wall charge is formed in the discharge cell. Next, in the light emission sustaining step Ic of the subfield, only discharge cells formed with the wall charge ("light emitting cells") are forced to sustain discharge by the number of times (or a period) allocated to the subfield to continue a light emitting state associated with the sustaining discharge. Therefore, by sequentially executing six subfields, light emission occurs the number of times (period) in accordance with a luminance level of an input video signal in each field, so that an intermediate luminance can be displayed corresponding to the input video signal.

Next, three types of configuration patterns for one field will be described with reference to FIG. 4.

Figure 4:
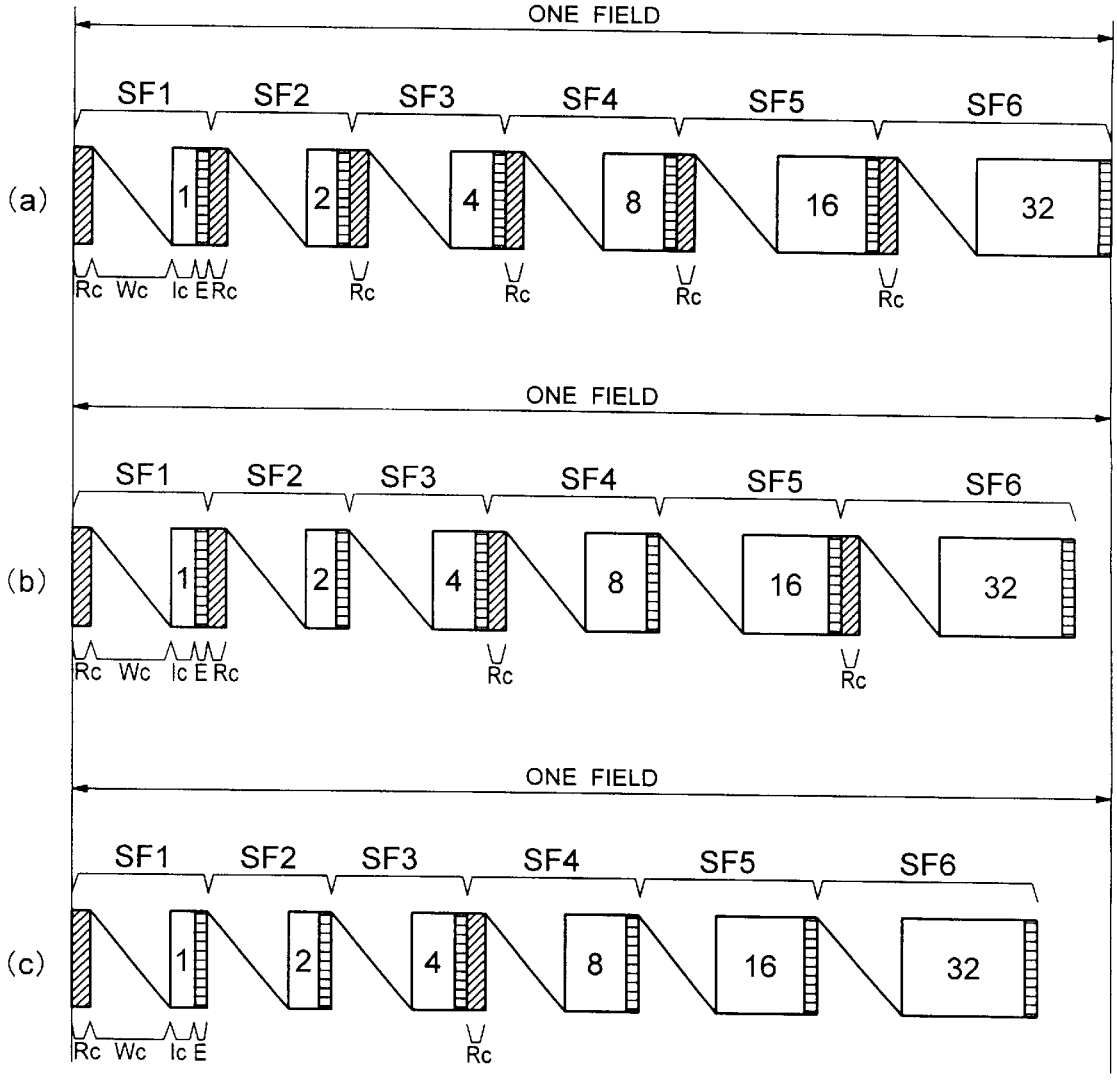
FIG. 4 is a diagram illustrating light emission driving formats based on a method according to the present invention.

A first configuration pattern, as illustrated in FIG. 4(*a*), is such that the simultaneous reset step Rc is performed without fail in each of all the subfields SF1–SF6 which make up one field.

A second configuration pattern, as illustrated in FIG. 4(*b*), performs the simultaneous reset step Rc in the first subfield SF1 in one field such that the simultaneous reset steps Rc is performed three times at substantially equal time intervals in one field. Next, in each of two subfields SF4, SF6, the simultaneous reset step Rc is performed.

A third configuration pattern, as illustrated in FIG. 4(*c*), performs the simultaneous reset step Rc at the first subfield SF1 in one field such that the simultaneous reset step Rc is performed twice at substantially equal time intervals in one field. Next, in a subfield SF4, the simultaneous reset step Rc is performed.

Next, a method of selecting a configuration pattern for one field will be described. The configuration pattern for one field is selected in accordance with the average luminance level LD of one field of pixel data intended for display.

Generally, the intensity of light emitted by a discharge in a discharge cell depends on the amounts of a space charge and wall charge remaining in the discharge cell in addition to an applied voltage. Therefore, even if a voltage level of a pulse applied for producing a discharge is the same, light intensity at the discharge varies depending on the amounts of the space charge and the wall charge remaining in the discharge cell. Also, the amounts of the remaining charges vary depending on the number of discharges within a predetermined time period and an elapsed time after termination of discharges, respectively. For this reason, as the number of discharges in a predetermined time period is smaller, a small amount of charges remains as compared with the case of a larger number of discharges. Also, the remaining charges tend to extinguish as the time elapses after termination of discharges.

As such, it is desirable that a predetermined amount of space charge is forced to exist in discharge cells at all times in order to stably provide a display of light intensity corresponding to pixel data PD without luminance variations. Therefore, when the average luminance level LD of one field is higher, the number of discharges in the light emission sustaining step in one field is larger as compared with the case where it is lower. Consequently, a larger amount of space charge remains in a discharge cell. Thus, when the average luminance level LD is higher, the number of reset discharges in one field can be reduced as compared with the case where LD is lower. In this way, since the reduction in the number of reset discharges in one field results in a reduction in light emission not related to pixel data, the contrast of a displayed image can be improved.

Figure 5:
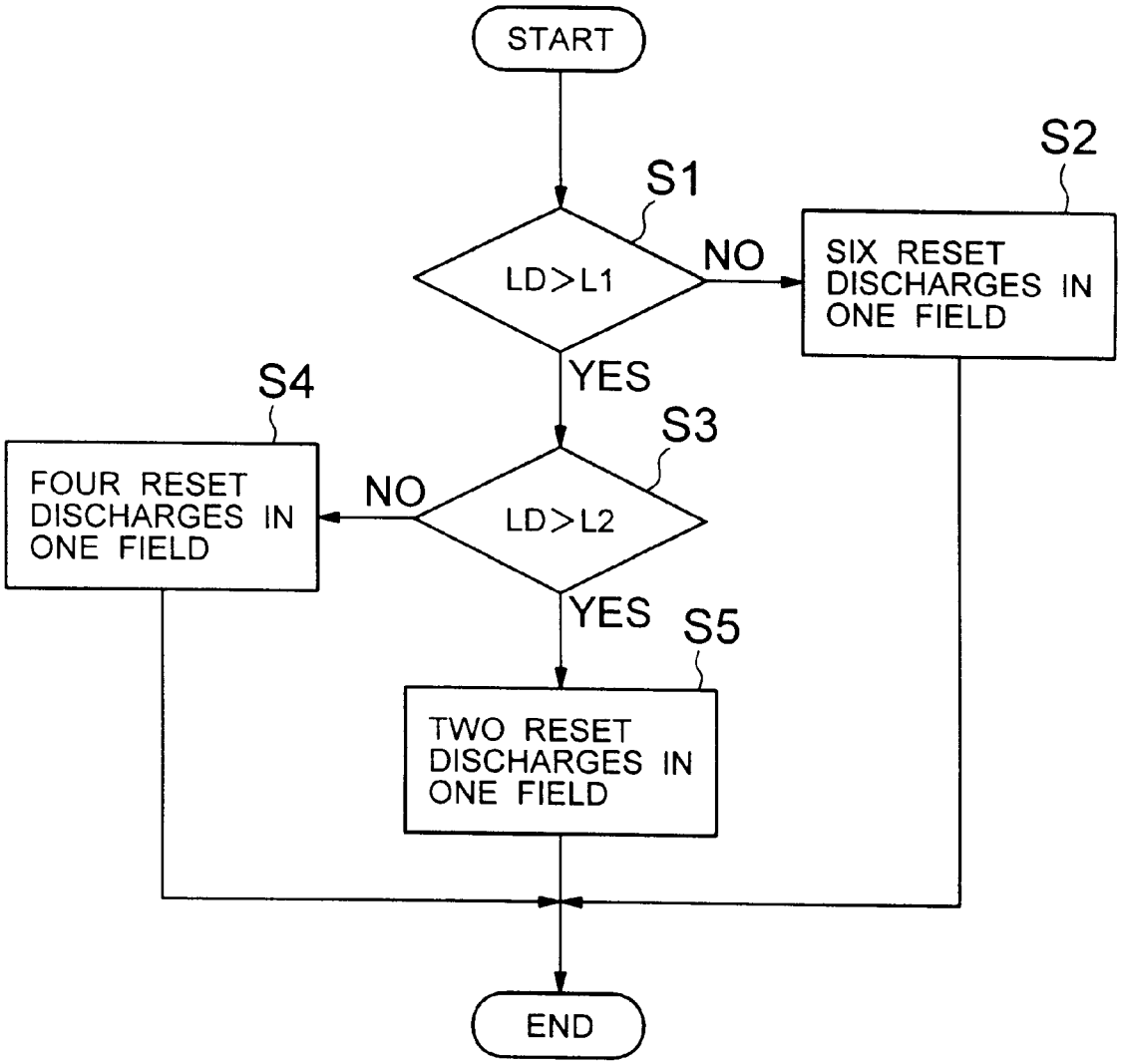
FIG. 5 is a flow chart of a routine for determining the number of reset discharges in accordance with the method according to the present invention.

In the following, a selection of a configuration pattern for one field will be specifically described based on FIGS. 4 and 5.

The driving controller 2 compares an average luminance level LD of one field supplied from the luminance detector 4 with two different predetermined levels L1, L2 (where L1<L2) to select a configuration pattern for the one field. First, the driving controller 2 compares the average luminance level LD with the predetermined level L1 (step S1). When the average luminance level LD is lower, this means that the number of sustain discharges in the field is smaller than a predetermined number. The driving controller 2 then proceeds to step S2, and selects the configuration pattern illustrated in FIG. 4(*a*), as the next field, to perform the simultaneous reset discharge six times in the field. In other words, the simultaneous reset discharge is performed in each subfield to actively form space charges in the discharge cells.

If the average luminance level LD is higher than the predetermined level L1, the average luminance level LD is further compared with the predetermined level L2 (step S3). If the average luminance level LD is lower, the driving controller 2 proceeds to step S4, and selects the configuration pattern illustrated in FIG. 4(*b*) as the next field. Specifically, the simultaneous reset discharge is performed four times in one field. In this case, since the sustaining discharges have been performed a relatively large number of times, the amount of space charges remaining in the discharge cells is larger as compared with the case where LD is lower than L1, so that the number of simultaneous reset discharges in the next field can be reduced.

If the average luminance level LD is higher than the predetermined level L2, the driving controller 2 proceeds to step S5, and selects the configuration pattern illustrated in FIG. 4(*c*). Specifically, the simultaneous reset discharge is performed twice in one field. In this case, since the sustaining discharges have been performed a large number of times, it can be determined that a significant amount of space discharges remains in the discharge cells, so that the number of simultaneous reset discharges in the next field can be further reduced.

In the manner described above, a configuration pattern for one field can be selected in accordance with an average luminance level of one field. Thus, when the number of sustaining discharges in the preceding field is larger, a large amount of space charges remains in the discharge cells. Therefore, even if the number of times of the simultaneous reset discharges is reduced in the next field, erroneous writing of pixel data will be avoided in the pixel data writing step.

By thus changing the number of simultaneous reset discharges in the next field in accordance with the number of discharges in the discharge cells in the preceding field, the improvement of the contrast of a displayed image can be achieved while minimally suppressing the simultaneous reset charges.

Next, a second embodiment of the present invention will be described with reference to FIGS. 4(*a*) and 6.

Figure 6:
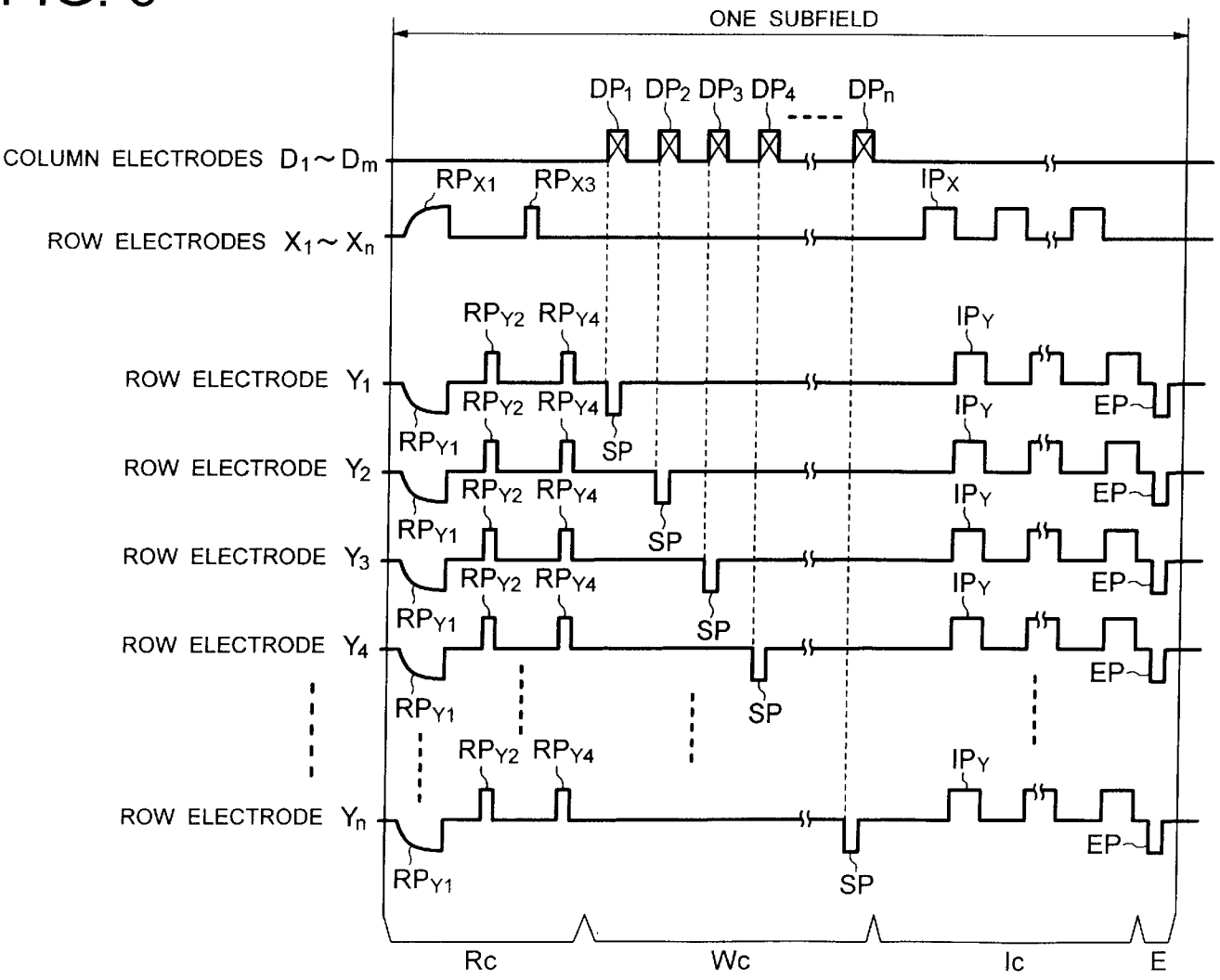
FIG. 6 is a diagram showing a second embodiment of application timings of driving pulses applied to the PDP 10.

One field comprises six subfields, similarly to the first embodiment. Each subfield comprises a simultaneous reset step Rc, a pixel data writing step Wc, a light emission sustaining step Ic, and an erasure step E, as illustrated in FIG. 6. The light emission sustaining step Ic and the erasure step E are similar to those of the first embodiment, respectively.

In the simultaneous reset step Rc, the first sustaining driver 7 generates, for example, reset pulses $RP_{X1}$ of positive polarity, which slowly rises, and applies them to the row electrodes $X_1$–$X_n$. Further, simultaneously with the reset pulses $RP_{X1}$, the second sustaining driver 8 generates reset pulses $RP_{Y1}$ of negative polarity, which slowly falls, and applies them to the row electrodes $Y_1$–$Y_n$. In response to the simultaneously applied reset pulses $PR_{X1}$, and $PR_{Y1}$, a first reset discharge occurs in all the discharge cells of the PDP 10 to generate a wall charge and a space charge in each discharge cell. Subsequently, reset discharges are performed three times, i.e., second reset discharges by second reset pulses $PR_{Y2}$ from the sustaining driver 8; third reset discharges by third reset pulses $RP_{X3}$ from the sustaining driver 7; and fourth reset discharges by fourth reset pulses $RP_{Y4}$ from the sustaining driver 8. With the above reset discharges, space charges can be formed in the discharge cells without fail.

Further, the number of the reset discharges is increased or decreased dependently on an average luminance level LD in the preceding field. Specifically, if the average luminance level LD is lower than a predetermined level, all of the first through fourth reset discharges are performed. This is because a smaller amount of space charges remains in the discharge cells due to a smaller number of sustain discharges in the preceding field, so that the supply of space discharges is required.

On the other hand, if the average luminance level LD is higher than the predetermined level, only the first reset discharge and the second reset discharge are performed. This is because since a large number of sustaining discharges have been performed in the preceding field, so that a large amount of space charges remains in the discharge cells. Thus, a plurality of discharges are not required.

The pixel data writing step Wc extinguishes the wall charges in the discharge cells in accordance with the pixel data bits DB to set the discharge cells to "light emission" or "non-light emission."

By thus reducing the number of reset discharges in the simultaneous reset step Rc in accordance with the number of sustaining discharges in the preceding field, the contrast of a displayed image can be improved.

Next, a third embodiment of the present invention will be described with reference to FIGS. 4(*a*) and 7.

Figure 7:
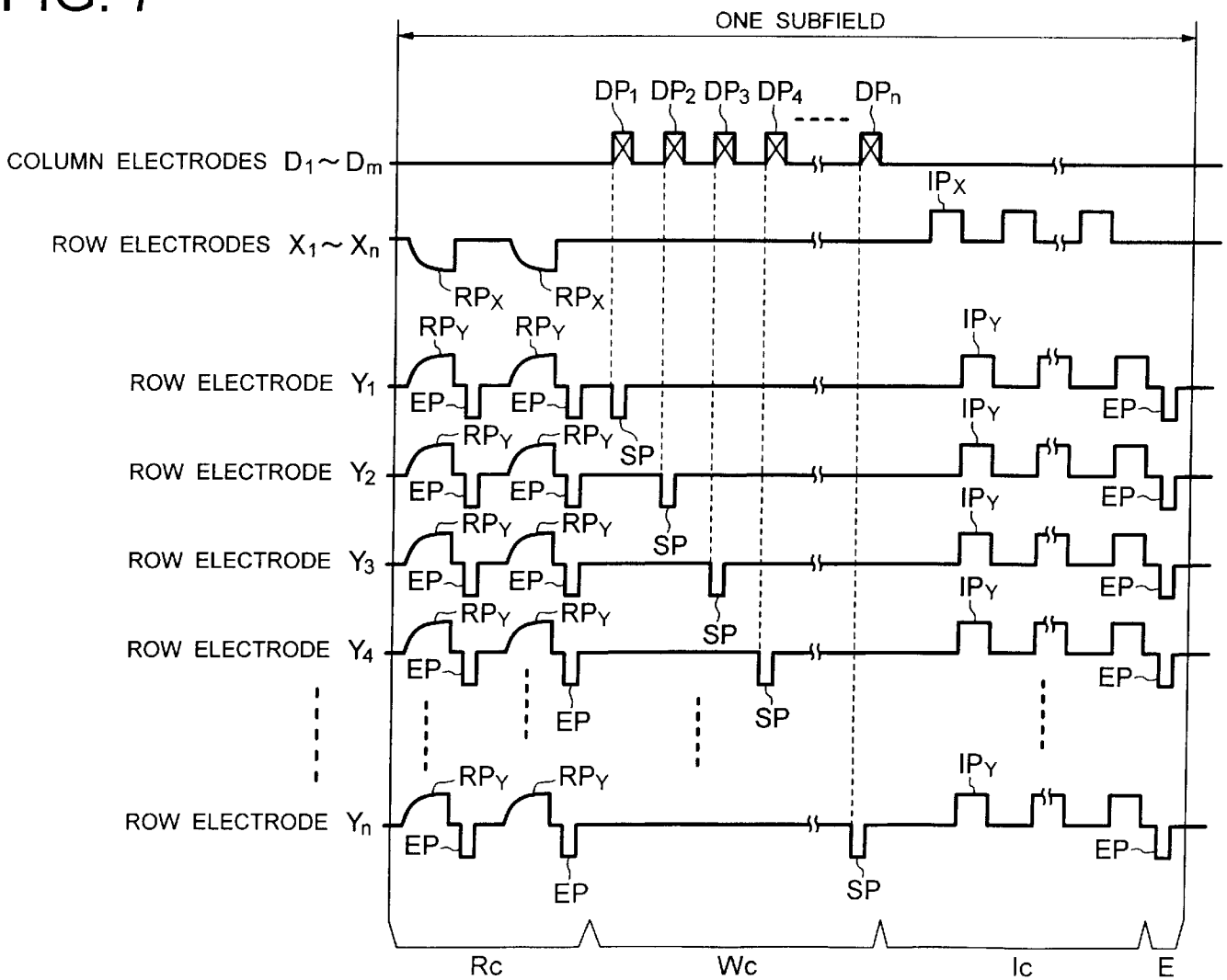
FIG. 7 is a diagram showing a third embodiment of application timings of driving pulses applied to the PDP 10.

One field is comprised of six subfields, similarly to the first embodiment. Each subfield comprises a simultaneous reset step Rc, a pixel data writing step Wc, a light emission sustaining step Ic, and an erasure step E, as illustrated in FIG. 7. The pixel data writing step Wc, light emission sustaining step Ic, and the erasure step E are similar to the first embodiment, respectively.

In the simultaneous reset step Rc, the first sustaining driver 7 generates, for example, reset pulses $RP_X$ of positive polarity, which slowly rises, and applies them to the row electrodes $X_1$–$X_n$. Further, simultaneously with the reset pulses $RP_X$, the second sustaining driver 8 generates reset pulses $RP_Y$ of negative polarity, which slowly falls, and applies them to the row electrodes $Y_1$–$Y_n$. In response to the simultaneously applied reset pulses $PR_X$ and $PR_Y$, a first reset discharge occurs in all the discharge cells of the PDP 10 to generate a wall charge and a space charge in each discharge cell. Subsequently, the second sustaining driver 8 generates erasure pulses EP of negative polarity which are applied to the row electrodes $Y_1$–$Y_n$. In response to the application of the erasure pulses EP, a discharge occurs in all discharge cells to extinguish wall charges formed in the discharge cells. Further, the application of the reset pulses $PR_X$ and $PR_Y$ and the erasure pulses EP is again repeated to stably supply space charges to the discharge cells, and to set all the discharge cells to the "non-light emitting" state.

The number of reset discharges involving the application of the reset and erasure pulses is increased or decreased dependent on an average luminance level LD in the preceding field. Specifically, if the average luminance level LD is lower than a predetermined level, the discharge setting is performed twice. This is because the number of sustaining discharges is smaller in the preceding field so that a small amount of space charges remains in the discharge cells. Thus more space charges is required to be stably supplied.

On the other hand, if the average luminance level LD is higher than the predetermined level, the reset discharge set is performed only once. This is because the number of sustaining discharges is larger in the preceding field so that a large amount of space charges remains in the discharge cells. Thus, a plurality of discharges are not required.

By thus reducing the number of reset discharge in the simultaneous reset step Rc in accordance with the number of sustaining discharges in the preceding field, the contrast of a displayed image is improved.

Next, a fourth embodiment of the present invention will be described based on FIGS. 8 through 13.

Figure 8:
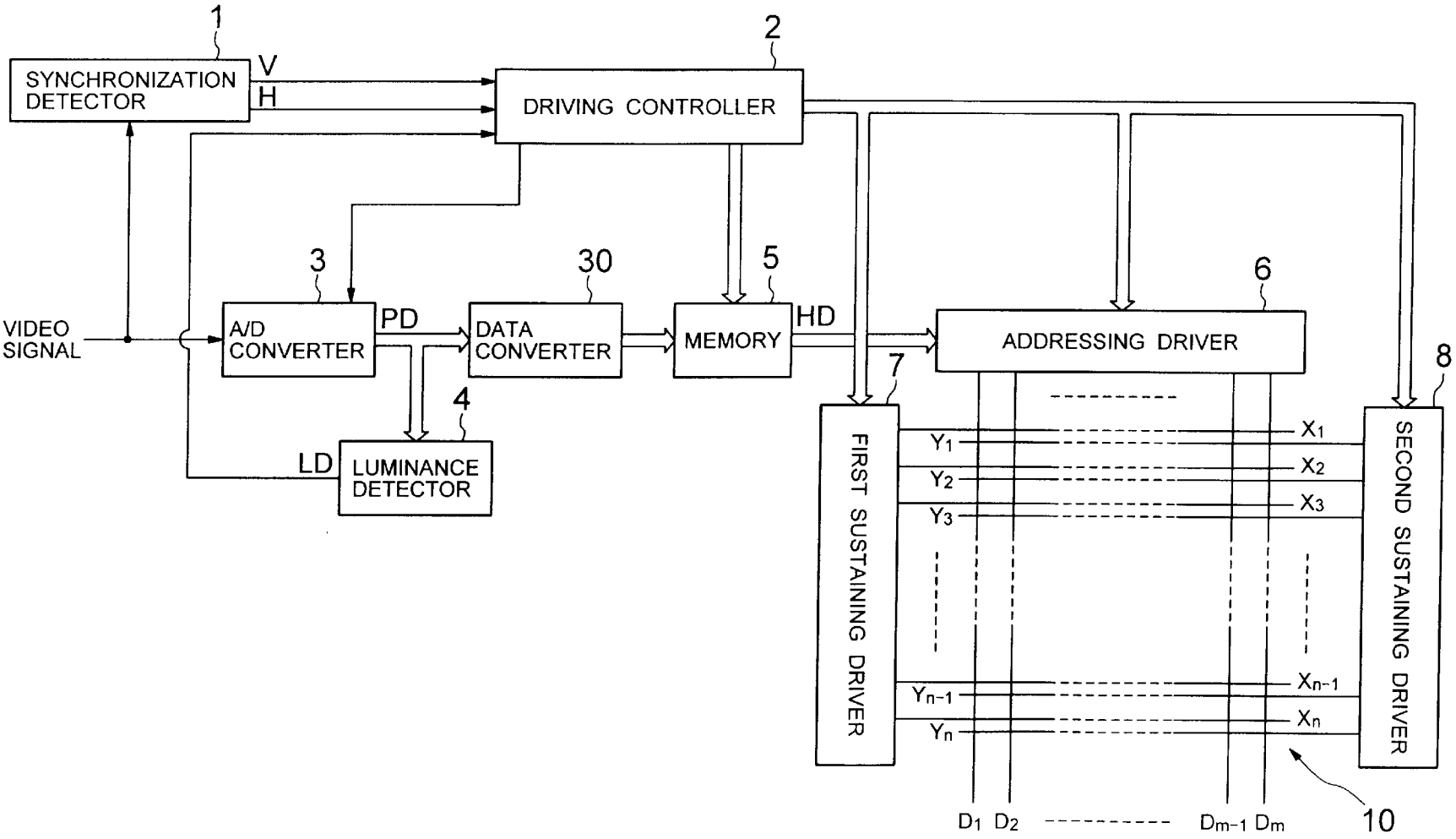
FIG. 8 is a block diagram of another embodiment of a plasma display apparatus for driving a plasma display panel in accordance with a method of the present invention.

As illustrated in FIG. 8, a plasma display apparatus of this embodiment comprises a PDP 10, and a driving unit which is composed of various functional modules.

The PDP 10 is configured similarly to that of the first embodiment. The driving unit comprises a synchronization detector 1, a driving controller 2, an A/D converter 3, a luminance detector 4, a data converter 30, a memory 5, an addressing driver 6, a first sustaining driver 7, and a second sustaining driver 8. The driving unit divides one field display period into, for example, six subfields SF1–SF6, as illustrated in FIG. 2, and drives the PDP 10 in gradation based on the aforementioned subfield method. At this time, the driver unit executes a simultaneous reset step Rc, a pixel data writing step Wc, a light emission sustaining step Ic, and an erasure step E respectively in each subfield.

The synchronization detector 1 detects a vertical synchronization signal from an input video signal to generate a vertical synchronization detecting signal V. The synchronization detector 1 also detects a horizontal synchronization signal to generate a horizontal synchronization detecting signal H. The synchronization detector 1 then supplies the vertical and horizontal synchronization detecting signals V and H to the driving controller 2.

The A/D converter 3 samples an analog input video signal in response to a clock signal supplied from the driving controller 2, converts the sampled signal to 8-bit pixel data (input pixel data) D for each pixel, and supplies it to the data converter 30.

The driving controller 2 generates the clock signal for the A/D converter 3 and a write/read signal for the memory 5 in synchronism with the horizontal and vertical synchronization signals in the input video signal. The driving controller 2 also generates a variety of timing signals for controlling each of the memory 5, the addressing driver 6, the first sustaining driver 7, and the second sustaining driver 8 in synchronism with the horizontal and vertical synchronization signals.

The data converter 30 converts 8-bit pixel data D to 8-bit converted pixel data (display pixel data) HD, and supplies it to the memory 5.

Figure 12:
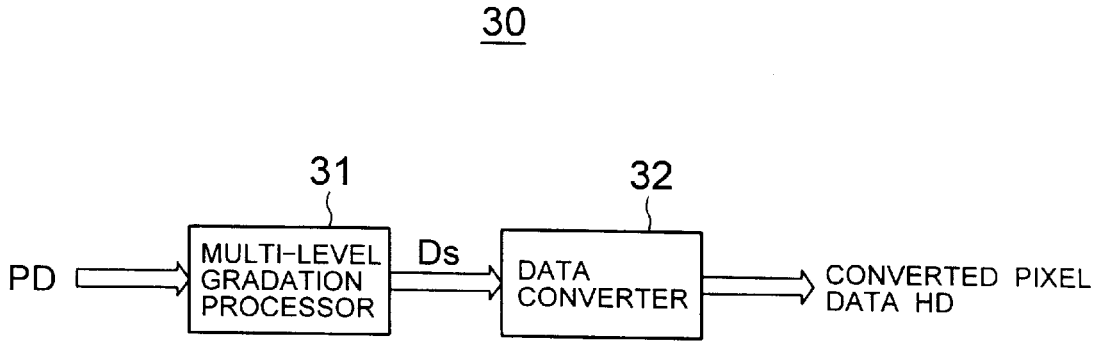
FIG. 12 s a block diagram illustrating the internal configuration of a data converter 30.

This data converter 30 comprises a multi-level gradation processor 31 and a data converter 32, as illustrated in FIG. 12. The multi-level gradation processor 31 applies multigradation processing such as error diffusion processing and dither processing to 8-bit pixel data PD. In this way, the multi-level gradation processor 31 generates multi-level gradation pixel data Ds consisting of four bits, as illustrated in FIG. 13, the total number of which is compressed while maintaining the number of visual luminance gradation levels at 256 gradation levels. The data converter 32 in turn converts the multi-level gradation pixel data DS to converted pixel data (display pixel data) HD comprised of first through eighth bits corresponding to each of subfields SF1–SF8 in FIG. 10 in accordance with a conversion table shown in FIG. 13. In FIG. 13, a bit at logical level "1" in the first through eighth bits in the converted pixel data HD indicates that a selective erasure discharge is performed in the pixel data writing step Wc in a subfield SF corresponding to the bit (indicated by a black circle).

The memory 5 sequentially writes the converted pixel data HD in accordance with a write signal supplied from the driving controller 2. As the writing is completed for one screen (n rows, m columns) by the writing operation, the memory 5 reads one screen of converted pixel data $HD_{11\text{-}nm}$ divided for each bit digit, and sequentially supplies it to the addressing driver 6 on a row by row basis.

The addressing driver 6 generates m pixel data pulses having a voltage corresponding to a logical level of each of converted pixel data bits for each line read from the memory 5 in response to a timing signal supplied from the driving controller 2, and applies them to the column electrodes $D_1$–$D_m$ of the PDP 10, respectively.

The PDP 10 comprises m column electrodes $D_1$–$D_m$ as address electrodes, and n row electrodes $X_1$–$X_n$, and row electrodes $Y_1Y_n$ which are arranged to intersect each of these column electrodes. In the PDP 10, row electrodes corresponding to one line are formed by a pair of the row electrode X and row electrode Y. Specifically, the first row electrode pair in the PDP 10 is row electrodes $X_1$ and $Y_1$, and an n-th row electrode pair is row electrodes $X_n$ and $Y_n$. Each of the row electrodes and column electrodes is covered with a dielectric layer to separate from a discharge space. The PDP has a structure in which a discharge cell corresponding to one pixel is formed at an intersection of a pair of row electrodes and a column electrode.

Each of the first sustaining driver 7 and the second sustaining driver 8 generates a variety of driving pulses as described below in response to timing signals supplied from the driving controller 2, and applies them to the row electrodes $X_1$–$X_n$ and $Y_1$–$Y_n$ of the PDP 10.

Figure 9:
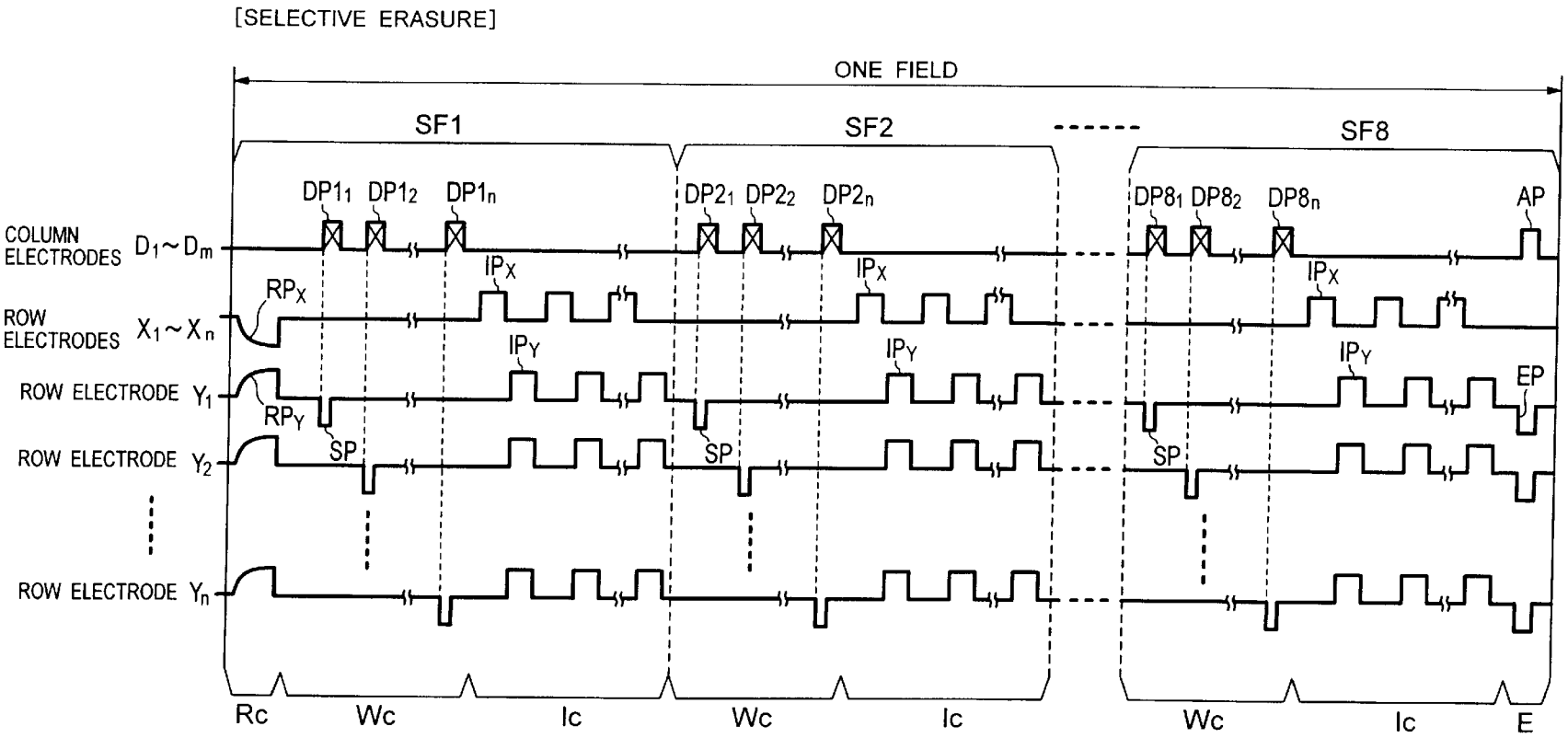
FIG. 9 is a diagram showing an example of application timings of driving pulses applied to a PDP 10.

FIG. 9 is a diagram showing application timings of a variety of driving pulses applied by each of the addressing driver 6, the sustaining driver 7, and the second sustaining driver 8 to the column electrode $D_1$–$D_m$ and the row electrodes $X_1$–$X_n$ and $Y_1$–$Y_n$ of the PDP 10.

Figure 10:
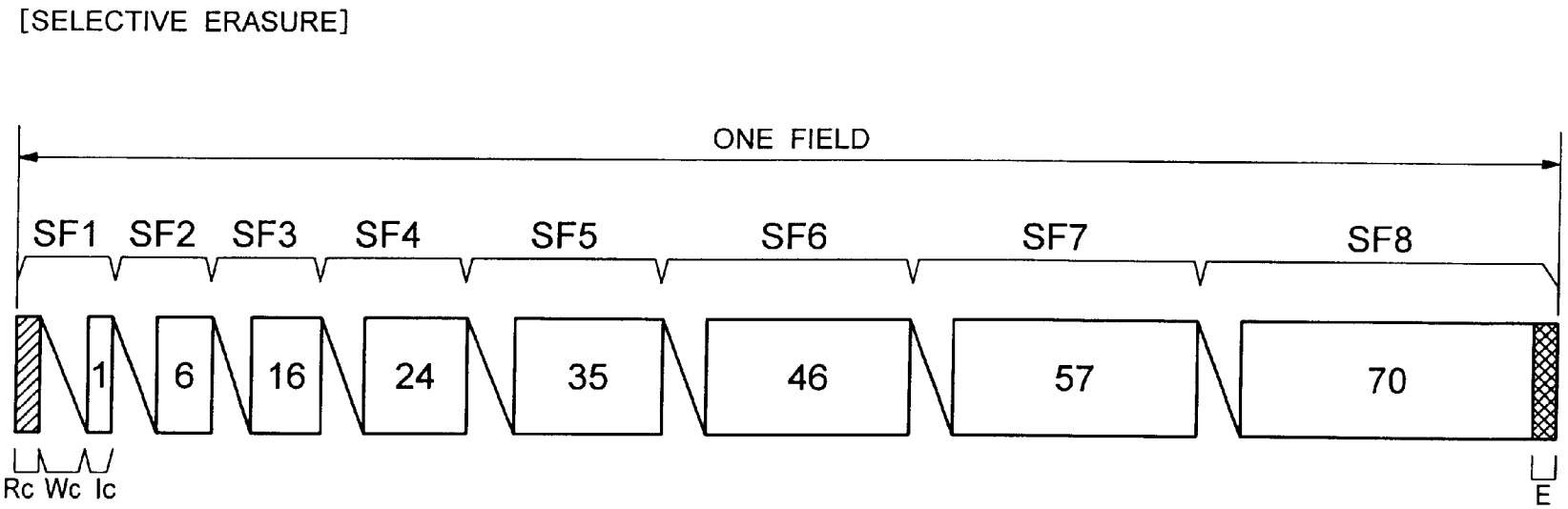
FIG. 10 is a diagram illustrating a light emission driving format based on the method of the present invention.

In an example illustrated in FIG. 10, one field display period is divided into eight subfields SF1–SF8 for driving the PDP 10. In each subfield, the pixel data writing step Wc for writing pixel data into each of discharge cells of the PDP 10 for setting light emitting cells and a non-light emitting cells, and the light emission sustaining step Ic for forcing only the light emitting cells to sustain light emission for a period (number of times) corresponding to weighting of each subfield are performed. Also, only in the first subfield SF1, the simultaneous reset step Rc for initializing all the discharge cells of the PDP 10 is performed, while the erasure step E is performed only in the last subfield SF8.

First, in the simultaneous reset step Rc, the discharge cells are discharged for resetting by the application of reset pulses from the first and the second sustaining drivers 7 and 8 to uniformly form a predetermined wall charge and space charge in each discharge cell.

Next, in the pixel data writing step Wc, the addressing driver 6 sequentially applies the column electrodes Dl-Dm with pixel data pulse groups $DP1_{1\text{-}n}$, $DP2_{1\text{-}n}$, $DP3_{1\text{-}n}$, . . . , $DP8_{1\text{-}n}$ of each row, as shown in FIG. 9. Specifically, in the subfield SF1, the addressing driver 6 applies pixel data pulse group $DP1_{1\text{-}n}$ corresponding to each of the first through n-th rows, generated based on the first bit of each of the converted pixel data $HD_{11\text{-}nm}$, with the column electrodes $D_1$–$D_m$ on a row by row basis. Also, in the subfield SF2, the pixel data pulse group $DP2_{1\text{-}n}$ based on the second bit of each of the converted pixel data $HD_{11\text{-}nm}$ are applied to the column electrodes $D_1$–$D_m$ on a row by row basis. In this event, the addressing driver 6 generates a pixel data pulse at a high voltage and applies it to the column electrodes D only when a bit logic of the converted pixel data is, for example, at a logical level "1." At the same timing as the application timing of each of the pixel data pulse groups DP, the second sustaining driver 8 generates scanning pulses SP and sequentially applies them to the row electrodes $Y_1$–$Y_n$. Here, a discharge occurs only in discharge cells at intersections of "rows" applied with the scanning pulse SP and "columns" applied with the pixel data pulse at the high voltage (selective erasure discharge), so that wall charges so far remaining in the discharge cells are selectively erased. With the selective erasure discharge, discharge cells initialized to the light emitting cell state in the simultaneous reset step Rc transitions to non-light emitting cells. On the other hand, no discharge is produced in discharge cells on "columns" that are not applied with the pixel data pulse at the high voltage, so that the discharge cells maintain the state initialized in the simultaneous reset step Rc, i.e., the light emitting cell state.

Specifically, according to the performance of the pixel data writing step Wc, light emitting cells maintained in the light emitting state and non-light emitting cells remaining in a non-emission state in the light emission sustaining step are alternately set in accordance with pixel data to perform so-called pixel data writing.

Also, in the light emission sustaining step Ic, the first sustaining driver 7 and the second sustaining driver 8 alternately apply the sustaining pulses $IP_X$ and $IP_Y$ to the row electrodes $X_1$–$X_n$ and $Y_1$–$Y_n$. In this event, the discharge cells in which the wall charges remain by the pixel data writing step Wc, i.e., the light emitting cells repeat discharge light emission to maintain their light emitting state in a period in which the sustaining pulses $IP_X$ and $IP_y$ are being alternately applied. The light emission sustaining period (the number of light emission discharges) is set to correspond to weighting for each subfield.

FIG. 10 is a diagram illustrating a light emission driving format in which a light emission sustaining period (the number of light emission discharges) is described for each subfield.

Specifically, in one field display period, the light emitting duration in the light emission sustaining step Ic is set for each of the subfields SF1–SF8 as follows:

SF1: 1
SF2: 6
SF3: 16
SF4: 24
SF5: 35
SF6: 46
SF7: 57
SF8: 70

Specifically, in each light emission sustaining step Ic, a discharge is produced only in discharge cells which are set to light emitting cells in the immediately preceding pixel data writing step Wc, to emit light for a light emitting duration shown in FIG. 10 in one field display period.

In the erasure step E, the addressing driver 6 generates erasure pulses AP and applies them to each of the column electrodes $D_{1-m}$. Further, the second sustaining driver 8 generates erasure pulses EP simultaneously with the application timing of the erasure pulses AP, and applies them to each of the row electrodes $Y_1$–$Y_n$. With the simultaneous application of the erasure pulses AP and EP, erasure discharges are produced in all the discharge cells in the PDP 10 to extinguish wall charges remaining in all the discharge cells.

In other words, by performing the erasure step E, all the discharge cells in the PDP 10 become non-light emitting cells.

FIG. 11 is a diagram showing all patterns of light emission driving based on the light emission driving format illustrated in FIG. 10.

As illustrated in FIG. 11, a selective erasure discharge is performed for each discharge cell only in the pixel data writing step Wc in one subfield of the subfields SF1–SF8 (indicated by a black circle). Specifically, the wall charges formed in all the discharge cells of the PDP 10 by performing the simultaneous reset step Rc remain until the selective erasure discharge is performed to promote discharge light emission in the light emission sustaining step Ic in each of subfields SF intervening therebetween (indicated by a white circle). Thus, each discharge cell is a light emitting cell until the selective erasure discharge is performed in the subfields indicated by black circles in FIG. 10. Thus, light emission is performed at a light emitting duration ratio as indicated in FIG. 10 in the light emission sustaining step Ic in each of the subfields intervening therebetween.

At this time, as shown in FIG. 11, the number of times by which each discharge cell transitions from a light emitting cell to a non-light emitting cell is ensured to be limited to once in one field period. In other words, a light emission driving pattern which allows a discharge cell having been set to a non-light emitting cell in one field period to be set again to a light emitting cell is prohibited.

Thus, the simultaneous reset operation which involves emission of strong light, though not contributing to image display, is required to be performed only once in one field period as shown in FIGS. 9 and 10, so that a reduction in the contrast can be suppressed.

Also, since the selective erasure discharge performed in one field period is once at most, as shown by the black circles in FIG. 11, the power consumption can be reduced. Further, false contour is also suppressed.

At this time, according to the light emission driving pattern shown in FIG. 11, light emission driving capable of representing the luminance at nine gradation levels is performed at the following light emission luminance ratio in one field display period:

{0:1:7:23:47:82:128:185:255}

In other words, two types of nine gradation level light emission driving each of which is different in terms of light emitting durations to be performed in each subfield are alternately performed on a field by field (frame by frame) basis. According to the driving, the number of visual display gradation levels is increased more than nine due to time integration. Thus, patterns of dither and error diffusion by the multi-level gradation processing become less prominent, so that S/N feeling is improved.

Next, the simultaneous reset step Rc will be described in detail. The simultaneous reset step Rc performed in this embodiment is identical to the simultaneous reset step shown in FIG. 6. As shown in FIG. 6, in the simultaneous reset step Rc, the first sustaining driver 7 generates reset pulses $RP_{X1}$ of positive polarity, which slowly rises, for example, and applies them to the row electrodes $X_1$–$X_n$. Further, simultaneously with the reset pulse $RP_{X1}$, the second sustaining driver 8 generates reset pulses $RP_{Y1}$ of negative polarity, which slowly falls, and applies them to the row electrodes $Y_1$–$Y_n$. In response to the simultaneously applied reset pulses $PR_{X1}$ and $PR_{Y1}$, a first reset discharge occurs in all the discharge cells of the PDP 10 to generate a wall charge and a space charge in each discharge cell. Subsequently, reset discharges are performed three times, i.e., second reset discharges by second reset pulses $PR_{Y2}$ from the sustaining driver 8; third reset discharges by third reset pulses $RP_{X3}$ from the sustaining driver 7; and fourth reset discharges by fourth reset pulses $RP_{Y4}$ from the sustaining driver 8. With the reset discharges mentioned above, space charges can be formed in the discharge cells without fail.

Further, the number of reset discharges is increased or decreased dependently on an average luminance level LD in the preceding field. Specifically, if the average luminance level LD is lower than a predetermined level, all of the first through fourth reset discharges are performed. This is because a small amount of space charges remains in the discharge cells due to a smaller number of sustain discharges in the preceding field, so that more space discharges is required to be stably supplied.

On the other hand, if the average luminance level LD is higher than the predetermined level, only the first reset discharge and the second reset discharge are performed. This is because a large amount of space charges remains in the discharge cells, since a large number of sustaining discharges have been performed in the preceding field. Thus, a plurality of discharges are not required.

By thus reducing the number of reset discharges in the simultaneous reset step Rc in accordance with the number of sustaining discharges in the preceding field, it is possible to improve the contrast of a displayed image.

While in the foregoing embodiments, discharge cells are set to either one of light emission or non-light emission by the selective erasure discharge to write pixel data. It is also within the scope of the present invention to set discharge cells to either one of light emission or non-light emission by selective writing discharge.

The present invention has been described with reference to its preferred embodiments. Those skilled in the art should understand that a variety of alterations and modifications can be contemplated. It is intended that these alterations and modifications are all covered by the appended claims.

This application is based on Japanese Patent Application No. 2000-153130 which is hereby incorporated by reference.

What is claimed is:

1. A method for driving a plasma display panel on the basis of input pixel data of a field, said plasma display panel comprising a plurality of row electrodes formed in pairs corresponding to each of a plurality of display lines, a plurality of column electrodes arranged to cross said row electrodes, each of said column electrodes forming a discharge cell corresponding to one pixel at each intersection with a pair of said plurality of row electrodes, a row electrode driving circuit for generating a row electrode driving pulse for driving said plurality of row electrodes, and a column electrode driving circuit for generating a column electrode driving pulse for driving said plurality of column electrodes, said method comprising the steps of (a) performing a reset discharge for initializing all of said discharge cells in said field, and (b) dividing a display period in said field into a plurality of subfields to perform a gradation display, and further comprising the step (c) of changing the number of reset discharges in said step (a) in accordance with luminance data in said input pixel data in a field preceding to said field, when said field is displayed.

2. The method according to claim 1, wherein said luminance data is an average luminance of said input pixel data in the preceding field, and further comprising the step of comparing said average luminance with a predetermined level, and when said average luminance is higher than said predetermined level, decreasing the number of said reset discharges in said step (a).

3. A method for driving a plasma display panel on the basis of input pixel data of a field, said plasma display panel comprising a plurality of row electrodes formed in pairs corresponding to each of a plurality of display lines, a plurality of column electrodes arranged to cross said row electrodes, each of said column electrodes forming a discharge cell corresponding to one pixel at each intersection with a pair of said plurality of row electrodes, a row electrode driving circuit for generating a row electrode driving pulse for driving said plurality of row electrodes, and a column electrode driving circuit for generating a column electrode driving pulse for driving said plurality of column electrodes, said method comprising the steps of (d) dividing a display period of said field into a plurality of subfields to perform a gradation display, and (e) performing a reset discharge for initializing all of said discharge cells in each of said subfields, and further comprising the step (f) of changing the number of said reset discharges in said step (e) in accordance with luminance data of input pixel data in a preceding field to said field, when said input pixel data is displayed.

4. The method according to claim 3, wherein said luminance data is an average luminance of said input pixel data in the preceding field; and further comprising the step of comparing said average luminance with a predetermined level, and when said average luminance is higher than said predetermined level, decreasing the number of said reset discharges in said step (e).

5. A method for driving a plasma display panel on the basis of input pixel data of a field, said plasma display panel comprising a plurality of row electrodes formed in pairs corresponding to each of a plurality of display lines, a plurality of column electrodes arranged to cross said row electrodes, each of said column electrodes forming a discharge cell corresponding to one pixel at each intersection with a pair of said plurality of row electrodes, a row electrode driving circuit for generating a row electrode driving pulse for driving said plurality of row electrodes, and a column electrode driving circuit for generating a column electrode driving pulse for driving said plurality of column electrodes, said method comprising the steps of (g) dividing a display period of said field into a plurality of subfields to perform a gradation display to perform a gradation display, and (h) performing a reset discharge for initializing all of said discharge cells in a first subfield of said field, and further comprising the step of (i) changing the number of said reset discharges in said step (h) in accordance with luminance data of input pixel data in a preceding field to said field when said input pixel data is displayed.

6. The method according to claim 5, wherein said luminance data is an average luminance of said input pixel data in the preceding field; and further comprising the step of comparing said average luminance with a predetermined level, and when said average luminance is higher than said predetermined level, decreasing the number of said reset discharges in said step (h).

* * * * *